United States Patent [19]

Brandt

[11] Patent Number: 4,633,528

[45] Date of Patent: Jan. 6, 1987

[54] BULLET AFFECTING/DEFLECTING MATERIAL

[76] Inventor: Raymond W. Brandt, 5828 Wheelock, Fort Wayne, Ind. 46815

[21] Appl. No.: 635,638

[22] Filed: Jul. 30, 1984

[51] Int. Cl.[4] ..... F41H 1/02; F41H 1/04; B32B 3/00

[52] U.S. Cl. ..... 2/2.5; 428/156; 428/161; 428/164; 428/172

[58] Field of Search ..... 428/156, 161, 162, 164, 428/172, 2.5

[56] References Cited

U.S. PATENT DOCUMENTS

| | | | |
|---|---|---|---|
| 1,465,767 | 8/1923 | Krause | 428/911 X |
| 1,513,766 | 11/1924 | Spooner | 428/911 X |
| 2,771,384 | 11/1956 | Collins | 428/911 X |
| 3,061,839 | 11/1962 | Foster | 428/175 X |
| 3,130,414 | 4/1964 | Bailey et al. | 2/2.5 |
| 3,563,836 | 2/1971 | Dunbar | 428/911 X |
| 3,829,899 | 8/1974 | Davis | 2/2.5 |
| 3,867,239 | 2/1975 | Alesi et al. | 428/911 X |
| 3,894,472 | 7/1975 | Davis | 428/911 X |
| 4,198,707 | 4/1980 | Haupt et al. | 2/2.5 |
| 4,241,457 | 12/1980 | Klein et al. | 428/911 X |
| 4,292,882 | 10/1981 | Clausen | 428/911 X |
| 4,316,286 | 2/1982 | Klein | 428/911 X |
| 4,443,506 | 4/1984 | Schmolmann | 428/911 X |

*Primary Examiner*—Nancy A. B. Swisher
*Attorney, Agent, or Firm*—Marshall & Melhorn

[57] ABSTRACT

A plate adapted to form a device for protecting a human body or the like has one surface formed in a plane at an angle with respect to the plane of an opposing surface. Pairs of such plates with the angled surfaces abutting can be enclosed in pockets formed in a flexible material to provide a sheet of protective material. A plurality of pairs of the plates can be arranged in overlapping pockets in rows and columns to form a protective vest or coat.

10 Claims, 10 Drawing Figures

BULLET AFFECTING/DEFLECTING MATERIAL

BACKGROUND OF THE INVENTION

1.Field of the Invention

The invention generally concerns protective materials and, in particular, materials for protecting a body by changing the trajectory of a bullet before it can penetrate the body.

2. Description of the Prior Art

Many forms of bulletproof protective garments are known in the prior art. For example, see U.S. Pat. Nos. 2,771,384; 3,061,839; 3,829,899; 3,867,239; 4,198,707; 4,292,882; and 4,316,286. Typically, these garments are fashioned to be worn by an individual to protect his body from a bullet. The garments are generally made from a plurality of plates formed of metallic or other suitable material which are fastened together in a shape to fit the body of the wearer.

U.S. Pat. No. 2,771,384 discloses a protective material formed of a multiplicity of layers of woven nylon fabric bonded together by a synthetic resin applied to the fabric in straight equally spaced parallel lines. An intermediate layer is joined to the layer next above it along lines which lie substantially midway between the bond lines which join the intermediate layer to the layer next below it. Thus, the fabric comprises a series of shallow, flat pockets lying in staggered relationship into which are inserted flat plates or inserts made of a fiber glass polyester laminate.

U.S. Pat. No. 3,061,839 discloses a fabric of double ply having face and back fabrics formed of heat shrinkable yarn woven, stitched or otherwise joined together at spaced apart rows and at spaced apart width at regularly spaced intervals to form pockets of desired dimensions into which ridged armor panels are inserted and then the fabric is heat shrunk around the panels.

U.S. Pat. No. 3,829,899 discloses bullet proof body armor formed of a pad comprising a number of loose sheets woven with heavy gauge nylon threads. The pad is enclosed within a cloth envelope having a pocket formed therein in the plane of the pad for removably receiving a semi-flexible metal insert plate. A number of the plate sections are arranged in the common plane, in edge-to-edge contact one above the other. Each of the edge-to-edge joints is covered by an overlapping cover plate and a flexible cloth-like sheet is secured to the exposed faces of the plate sections to secure them together and permit flexing of the plate transversely to the joints.

U.S. Pat. No. 3,867,239 discloses a flexible armor material comprising an array of platelets with contoured edges or reinforced joints supported by a flexible membrane.

U.S. Pat. No. 4,198,707 discloses a soft protective material having double layers of mutually moveable rectangular or square protective plates inserted into pockets of a carrier material. The outer layers of plates are made of steel and at least portions thereof overlap in scale-like fashion. The inner layer is designed to absorb or largely destroy the impact energy of a striking bullet and is formed of a thick shock absorbing material such as a polyamide. The inner plates are arranged in a common plane and are joined together in a form-locked manner along the horizontally oriented meeting plate edges by slide joints and along the vertically oriented meeting plate edges by rotating joints.

U.S. Pat. No. 4,292,882 discloses a bullet proof armor comprising a laminated pad with front and rear surfaces composed of a plurality of loosely related fabric sheets woven of fibers having high tensile strength and metal abrading particulate material at the front surface adapted to abrade and condition the surface of the bullets whereby the fibers of the fabric can better grip and hold on to the bullets.

U.S. Pat. No. 4,316,286 discloses a protective plate assembly including a plurality of first plates arranged in vertical edge-to-edge relationship, each plate being formed with contiguous first and second portions with the second portion disposed at a predetermined angle with respect to the first portion such that the first plate closely conforms to the shape of the upper torso of a human being along the vertical plane. One of the lateral edges of the second portion of certain of the first plates is notched or disposed at an obtuse angle with the corresponding contiguous edge of the first portion of the first plate so as to enable the first plates to flex or hinge about the adjoining vertical edges. A plurality of second plates are disposed over the joints between adjoining edges of the first plates.

All of the above protective materials are designed to prevent a bullet from penetrating the body of the wearer by absorbing the energy in the bullet without materially affecting the trajectory of the bullet. However, a new type of armor penetrating bullet such as those coated with Teflon brand material are able to penetrate the prior art garments. Increasing the thickness of the material to stop the newer type bullet results in a very bulky and heavy protective garment which is unsuitable for prolonged use or action.

SUMMARY OF THE INVENTION

The present invention concerns a protective material formed of a plurality of pairs of superposed plates of energy absorbing material. The abutting surfaces of each pair of plates are formed at an angle with respect to the inner and outer faces of the plates of the pair. When a bullet strikes the outer plate, a portion of the kinetic energy of the bullet will be directed parallel to the planes of the abutting surfaces of the plates thereby causing the outer and inner plates to shift position with respect to one another along the plane of the abutting surfaces. The shifting of the plates will affect the trajectory of the bullet thereby deflecting it from its path. Depending upon the angle at which the bullet strikes the outer surface of the outer plate, the kinetic energy in the bullet, and the physical characteristics of a bullet and the plates, the bullet can be prevented from penetrating the body of the wearer. However, even if the bullet does penetrate the body of the wearer, the shifting plates according to the present invention will tend to alter the path of the bullet toward a path which is tangential to the surface of the body of the wearer thereby reducing injuries.

It is an object of the present invention to provide a protective material which increases the degree of protection for the body of the wearer against a bullet.

It is another object of the present invention to provide a protective material which affects the trajectory of a bullet as it penetrates the protective material.

BRIEF DESCRIPTION OF THE DRAWINGS

The various features, advantages and other uses of this invention will become more apparent by referring to the following detailed description and drawing in which.

DESCRIPTION OF THE PREFERRED EMBODIMENT

Figure 1:
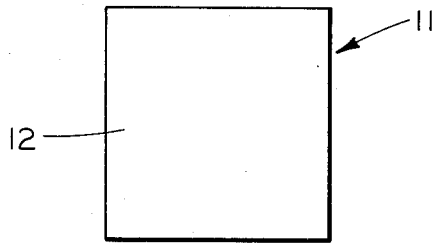
FIG. 1 is a front elevational view of a plate of protecting material according to the present invention.
Figure 2:
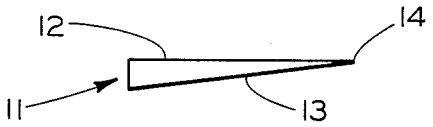
FIG. 2 is a bottom plan view of the plate of FIG. 1.

There is shown in FIG. 1 and FIG. 2 a plate of protective material for use in constructing a sheet of protective material for affecting the trajectory of and deflecting a bullet according to the present invention. The plate 11 has an outer surface 12 which is typically positioned parallel to the outer surface of a body to be protected. An opposing inner surface 13 is formed in a plane which intersects the plane of the surface 12 at an edge 14 of the plate 11.

Figure 3:
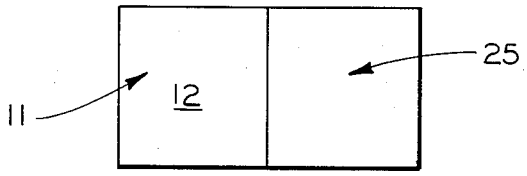
FIG. 3 is a front elevational view of two adjacent pairs of plates of protective material according to the present invention.
Figure 4:
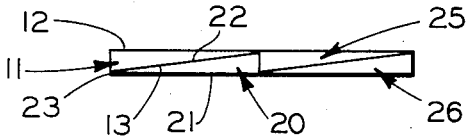
FIG. 4 is a bottom plan view of the plates shown in FIG. 3.

As shown in FIG. 4, a complimentary plate 20 has an inner surface 21 and an outer surface 22 formed in a plane which intersects the plane of the inner surface 21 at an angle at an edge 23. The inner surface 13 of the plate 11 and the outer surface 22 of the plate 20 are positioned in abutting relationship when the plates are superposed whereby the surfaces 12 and 21 are in generally parallel planes. Additional pairs of plates, such as plates 25 and 26 shown in FIG. 4 can be positioned in an edge abutting relationship to other pairs of plates as shown in FIG. 3 and FIG. 4 to form a sheet of protective material.

Figure 5:
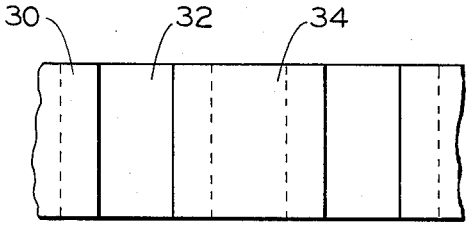
FIG. 5 is front elevational view of a plurality of pairs of plates of protective material according to the present invention arranged in overlapping fashion in a row.
Figure 6:
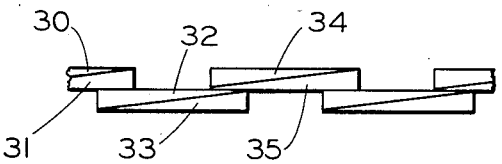
FIG. 6 is a bottom plan view of the plates shown in FIG. 5.

In the alternative, the pairs of plates can be positioned in overlapping relationship such as shown in FIG. 5 and FIG. 6. A pair of plates such as outer plate 30 and inner plate 31 can be positioned to overlap a portion of an outer plate 32 of a pair of plates, outer plate 32 and inner plate 33. An opposite edge portion of the outer plate 32 can be overlapped by an edge portion of inner plate 35 of a pair of plates, outer plate 34 and inner plate 35.

Although the plates have been shown in rows of pairs, they could be overlapped in columns. Also, each pair of plates can be rotated in the plane of its outer surface to any desired orientation.

Figure 7:
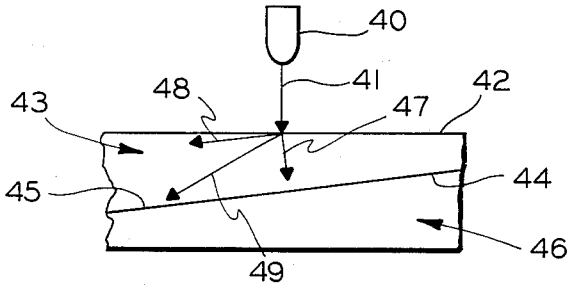
FIG. 7 is an enlarged plan view of a portion of a pair of plates according to the present invention showing force vectors imposed by a bullet striking the outer plate.

As shown in FIG. 7, a bullet 40 can be fired along a path 41 to strike an outer surface 42 of an outer plate 43. The outer plate 43 has an inner surface 44 which abuts an outer surface 45 of an inner plate 46. The kinetic energy of the bullet 40 directed along the path 41 is split into vectors 47 and 48 upon impact with the plate 43. A portion of the kinetic energy is directed along the vector 47 perpendicular to the abutting surfaces 44 and 45. Thus, the plates 43 and 46 must absorb this kinetic energy or the bullet will penetrate both plates and enter the body of the wearer.

A second portion of the kinetic energy is expended along the vector 48 in a direction parallel to the abutting surfaces 44 and 45. This kinetic energy tends to force the plates 43 and 46 to slide with respect to one another along the plane of the surfaces 44 and 45 thereby shifting the position of the plates. The shifting of the plates tends to affect the trajectory of the bullet such that it is deflected from the path 41 along a new path 49. The path 49 generally tends to be closer to a path tangential to the body of the wearer of the protective material than the path 41. Thus, even if the bullet penetrates both plates 43 and 46, the path of the bullet into the body of the wearer is at a shallower angle than it would have been had the plates not shifted. Typically, the result is a less serious wound to the wearer.

Figure 8:
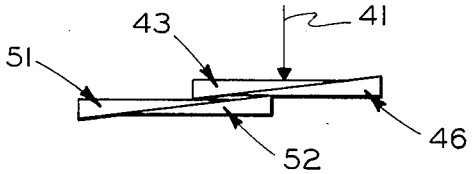
FIG. 8 is a plan view of two pairs of overlapping plates showing the shifting of the outer plate of each pair as caused by the striking of a bullet.

There is shown in FIG. 8 two pairs of plates in overlapping relationship. A bullet has struck the plate 43 along the path 41 and has shifted the plate 43 with respect to the plate 46. The shifting of the plate 43 has caused a shifting of a plate 51 with respect to a plate 52, which plates are partially overlapped by the plates 43 and 46.

Figure 9:
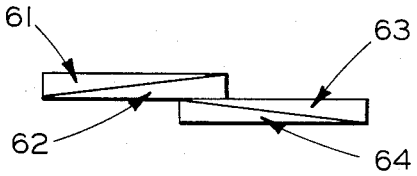
FIG. 9 is a plan view of an alternate orientation of two pairs of plates arranged in overlapping fashion according to the present invention.

There is shown in FIG. 9 a pair of plates, outer plate 61 and inner plate 62, which are positioned in overlapping relationship to a pair of plates, outer plate 63 and inner plate 64. These pairs of plates are positioned with the abutting angled surfaces in opposite orientations as an example of an alternate arrangement of overlapping plates.

Figure 10:
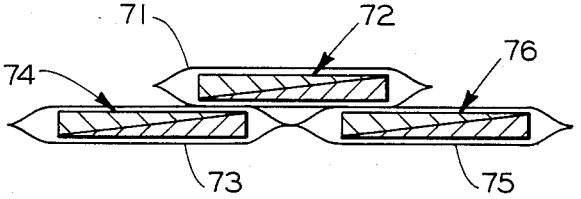
FIG. 10 is a top plan view of overlapping pairs of plates taken as if in cross section in a sheet assembly according to the present invention.

FIG. 10 shows a portion of a sheet of protective material according to the present invention in which a pocket 71 encloses a pair of plates 72 shown as if in cross section. The pocket 71 and plates 72 overlie a portion of a pocket 73 enclosing a pair of plates 74 along one side of the pair of plates 72. Along the other side of the plates 72, there is a pocket 75 enclosing a pair of plates 76 which underly an edge portion of the plates 72. The pockets 71, 73 and 75 can be attached together by any conventional means and are utilized to maintain both the pairs of plates and the plates of each pair in a predetermined relationship to one another such that a sheet of protective material can be formed into an article of clothing such as a vest, or a coat, or the like. Typically, the pockets are formed of sheets of cloth or other flexible material.

In accordance with the provisions of the patent statutes, the principle and mode of operation of the present invention has been explained and illustrated in its preferred embodiment. However, it must be appreciated that the present invention can be practiced otherwise than as specifically explained and illustrated without departing from its spirit or scope.

What is claimed is:

1. A protective device having inner and outer surfaces relative to a body to be protected comprising:

a first plate having a first planar surface which defines first and second orthogonal axes and an outer surface relative to a body to be protected and a second planar surface which defines a longitudinal axis generally tangential to said first and second axes and formed in a plane at a predetermined angle to said first planar surface, said second planar surface intersecting said first planar surface at an edge thereof, said first, second and tangential axes extending generally longitudinally and tangentially with respect to the body;

a second plate having a first planar surface which defines first and second orthogonal axes and an inner surface relative to the body to be protected and a second planar surface which defines a longitudinal axis generally tangential to said second axis of said first planar surface of said second plate and formed at said predetermined angle to a plane of said inner surface, said second planar surface intersecting said first planar surface at an edge thereof, said first, second and tangential axes of said second plate extending generally longitudinally and tangentially with respect to the body and generally parallel to the corresponding ones of said first, second and tangential axes of said first plate along substantially the whole length of the tangential axis, and wherein said second surfaces of said first and second plates are positioned in abutting relationship whereby when a projectile strikes said first planar surface of said first plate, said first and second plates move relative to one another along said longitudinal axes and along said second planar surfaces; and a flexible sheet of material forming a pocket enclosing said first and second plates and adapted to be worn on a body to be protected.

2. The protective device according to claim 1 wherein said inner and outer surfaces lie in planes which are generally parallel to one another.

3. The protective device according to claim 1 wherein said first and second plates are formed from an energy absorbing material.

4. The protective device according to claim 1 including at least two of each of said first and second plates associated in pairs of said first and second plates and wherein said pairs are positioned with one of said first surfaces of one of said pairs at least partially overlapping one of said first surfaces of the other one of said pairs.

5. The protective device according to claim 1 wherein said first and second plates are formed of a fiber glass polyester laminate material.

6. The protective device according to claim 1 wherein said first and second plates are formed of a metal material.

7. A garment for a body including a sheet of protective material comprising: flexible sheet means having at least two adjacent pockets, a pair of cooperating plates enclosed by each of said pockets, each of said plates having a first planar surface which defines first and second orthogonal axes and a second planar surface which defines a longitudinal axis generally tangential to an associated one of said second axes, said first, second and tangential axes of each of said pairs of plates extending generally longitudinally and tangentially with respect to the body, each of said second planar surfaces being formed in a plane at a predetermined angle with respect to a plane of an associated one of said first surfaces, said second planar surface intersecting said first planar surface to form a first edge of said plate, and said first, second and tangential axes of one of said pair of plates being generally parallel to the corresponding ones of said first, second and tangential axes of the other cooperating one of said pair of plates, said second surfaces of said plates in each pair being maintained in abutting relation to one another by said pockets whereby when a projectile strikes one of said first planar surfaces of one of said pairs of plates, said plates of said one pair move relative to one another along said associated longitudinal axes and said associated second planar surfaces.

8. The sheet of protective material according to claim 7 wherein said pockets overlap along adjacent edges thereof and said pairs of plates enclosed in said pockets overlap along adjacent edges thereof.

9. The sheet of protective material according to claim 7 wherein said plates are formed of an energy absorbing material.

10. The sheet of protective material according to claim 7 wherein said flexible sheet means is formed of cloth.

* * * * *